US009679726B2

(12) United States Patent
Xu et al.

(10) Patent No.: US 9,679,726 B2
(45) Date of Patent: Jun. 13, 2017

(54) ANTI-INTERFERENCE SWITCH SIGNAL TRANSMISSION CIRCUIT

(71) Applicant: Beijing Sifang Automation Co., Ltd., Beijing (CN)

(72) Inventors: Gang Xu, Beijing (CN); Tao Zhang, Beijing (CN); An Liu, Beijing (CN); Qiurong Chen, Beijing (CN); Wenhao Shi, Beijing (CN)

(73) Assignee: Beijing Sifang Automation Co., Ltd, Beijing (CN)

( * ) Notice: Subject to any disclaimer, the term of this patent is extended or adjusted under 35 U.S.C. 154(b) by 226 days.

(21) Appl. No.: 14/405,449

(22) PCT Filed: Aug. 23, 2013

(86) PCT No.: PCT/CN2013/000998
§ 371 (c)(1),
(2) Date: Dec. 4, 2014

(87) PCT Pub. No.: WO2014/032395
PCT Pub. Date: Mar. 6, 2014

(65) Prior Publication Data

US 2015/0137620 A1 May 21, 2015

(30) Foreign Application Priority Data

Aug. 27, 2012 (CN) ..... 2012 1 0307955

(51) Int. Cl.
*H01H 47/00* (2006.01)
*H01H 71/04* (2006.01)

(52) U.S. Cl.
CPC ..... *H01H 47/00* (2013.01); *H01H 47/001* (2013.01); *H01H 47/002* (2013.01); *H01H 71/04* (2013.01); *Y10T 307/937* (2015.04)

(58) Field of Classification Search
CPC .... H01H 47/00; H01H 47/001; H01H 47/002; H01H 47/226; H01H 47/325; H01H 71/04; Y10T 307/937; H01F 7/1844
(Continued)

(56) References Cited

U.S. PATENT DOCUMENTS 6,021,038 A * 2/2000 Hanchett, Jr. ..... H01F 7/1844 361/155
8,410,782 B2 * 4/2013 Shi ..... G01R 31/3277 324/415

FOREIGN PATENT DOCUMENTS

CN 2050172 U 12/1989
CN 101158701 A 4/2008
(Continued)

*Primary Examiner* — Hal Kaplan
(74) *Attorney, Agent, or Firm* — Muirhead and Saturnelli, LLC

(57) ABSTRACT

An anti-interference switch signal transmission circuit, in which a changeover switch is used at a signal terminal, is disclosed. A normally closed contact is connected to DC−, a normally open contact is connected to DC+, and a common contact is connected to a switch signal acquisition circuit. When no signal exists, DC− is provided to a positive input terminal of the switch signal acquisition circuit via the normally closed contact. Since a negative input terminal of the switch signal acquisition circuit is also connected to DC−, even if interference is caused, no false signal is generated. When a signal exists, the position of the changeover switch changes and DC+ is connected to DC− via the closed normally open contact through the switch signal acquisition circuit thus a loop is formed, so that the signal can be detected.

3 Claims, 1 Drawing Sheet

(58) Field of Classification Search
USPC ..... 307/139; 361/160
See application file for complete search history.

(56) References Cited

FOREIGN PATENT DOCUMENTS

| | | | |
|---|---|---|---|
| CN | 201331563 | Y | 10/2009 |
| CN | 201562001 | U | 8/2010 |
| CN | 102809680 | A | 12/2012 |

* cited by examiner

ANTI-INTERFERENCE SWITCH SIGNAL TRANSMISSION CIRCUIT

FIELD OF THE INVENTION

The present invention generally relates to switch signal transmission and relay protection in electric power system, and more particularly, to a design of anti-interference switch signal transmission circuit which solves the problem of interference.

BACKGROUND OF THE INVENTION

In a power system, information of equipment, such as location and state information equipment, needs to be transmitted by a switch or digital signal, especially between primary equipment, between secondary equipment, or between primary equipment and secondary equipment in a power plant and a transformer substation. Generally, this may be achieved by using a dry contact (i.e., a contact with no initial voltage applied thereto) at a signal terminal to switch a signal, which remains open when no signal input exists and becomes closed when an input signal comes in. Meanwhile, a switch signal acquisition circuit is arranged at a receiving terminal to form a loop between DC+, the dry contact, the switch signal acquisition circuit, and DC−. When there is no signal in this system, the contact is open; in this way, there is no current in the acquisition circuit. On the other hand, when there are signals, the contact is closed and the acquisition circuit is ON in order to output the correct signals. Nonetheless, the existence of distributed capacitance, AC interfusion, and/or control cable crosstalk may lead to wrong signal output in the transmission process of the switch signals due to interference. The general solutions for this problem are as follows:

1) Debouncing is added in the switch signal acquisition circuit to avoid the period of interference.

2) The drive current of the switch signal acquisition circuit is increased to inhibit interference.

However, both of these approaches have limitations. Thus, the interference problem cannot be fundamentally solved. For example, AC interfusion could not be completely solved.

SUMMARY OF THE INVENTION

In order to solve the existing problems in the prior art, an anti-interference switch signal transmission circuit is provided.

The transmission circuit includes a changeover switch, a negative terminal of a DC power supply DC−, a positive terminal of the DC power supply DC+, and a switch signal acquisition circuit;

the changeover switch includes a normally open contact and a normally closed contact;

the changeover switch is controlled by a signal terminal that receives a signal;

one terminal of the switch signal acquisition circuit is linked with the positive terminal DC+ by the normally open contact, and the other terminal is connected to DC−;

one terminal of the switch signal acquisition circuit is linked with the negative terminal DC− by the normally closed contact, and the other terminal is connected to DC−;

when no switch signal occurs, the normally open contact is open and the normally closed contact is closed, the circuit level of the switch signal acquisition circuit is negative; and when there are switch signals, the normally closed contact is open and the normally open contact is closed, the positive terminal DC+ is connected to the negative terminal DC− via the closed normally open contact so as to form a loop, thus the switch signal acquisition circuit is ON.

The present invention provides additional contact wiring. In this way, the changeover switch is controlled by the signal terminal. When there is no switch signal, DC− is connected with the normally closed contact, thus the loop level is always at a DC− State so that the output is not changed by outside interference. When there are signals, a position of the changeover switch will change. DC+ is connected to DC− via the closed normally open contact, so as to output correct signals.

This invention changes the original position status of the contact of the acquisition circuit without switch signal transmission. That is, a DC− connection is added to link with the normally closed contact of the changeover switch. In this case, when there is no signal in the system, both of the terminals of the switch signal acquisition circuit are connected with DC− so that the system will not be affected by outside interference.

The technical effects of the invention are as follows:

1. The invention has solved the interference problem by connecting both terminals of the switch signal acquisition circuit to DC− when there are no signals in the system.

2. The state with or without a switch signal is switched by the operation mode of the changeover switch.

DETAILED DESCRIPTION OF THE PREFERRED EMBODIMENTS

The present invention will be more fully understood from the following detailed description of embodiments thereof, taken together with the drawings.

Figure 1:
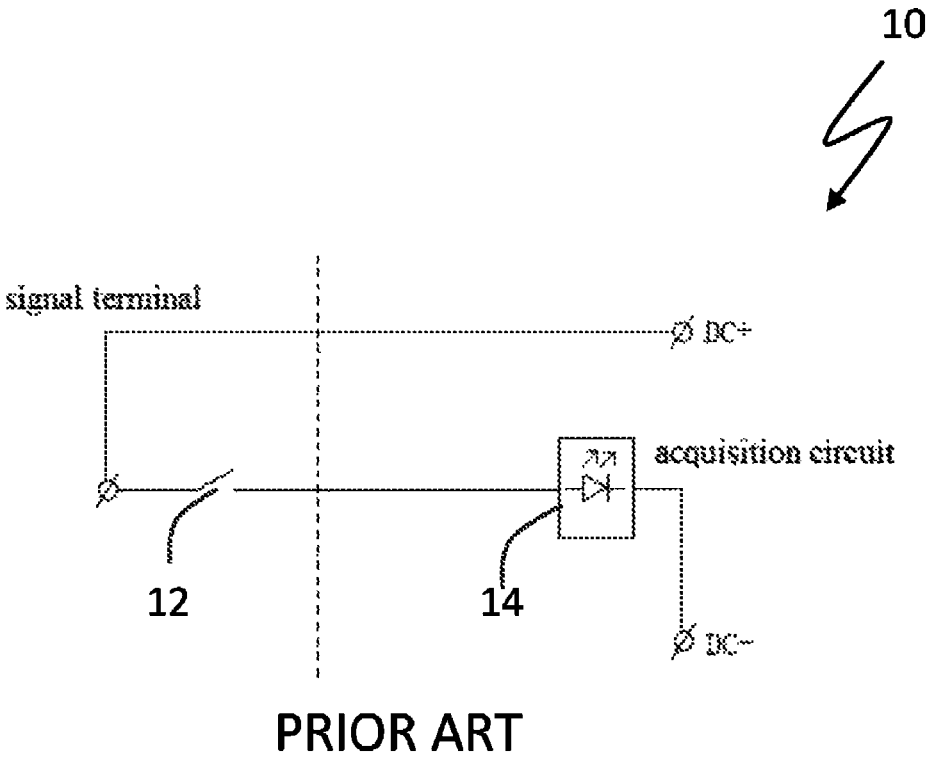
PRIOR ART Figure 1
FIG. 1 shows a schematic illustration of a prior art switch signal transmission circuit.

FIG. 1 is a schematic illustration of a prior art switch signal transmission circuit 10. DC+ is connected to a switch signal acquisition circuit 14 via a normally open contact 12. When there are switch signals in the system, the signal terminal controls the normally open contact 12 to be closed so as to form a loop that includes DC+, the closed normally open contact 12, the switch signal acquisition circuit 14, and DC−. As a result, the switch signal acquisition circuit 14 is connected and thus reflects the switch signals. The problem of this kind of wiring is the close proximity of individual switch signal transmission cables. When there is no switch signal in a cable, the cable may act as an antenna to receive interference from other cables. When the interference reaches a certain intensity, the acquisition circuit 14 could mistakenly consider the interference as a switch signal and thus make an error.

Figure 2:
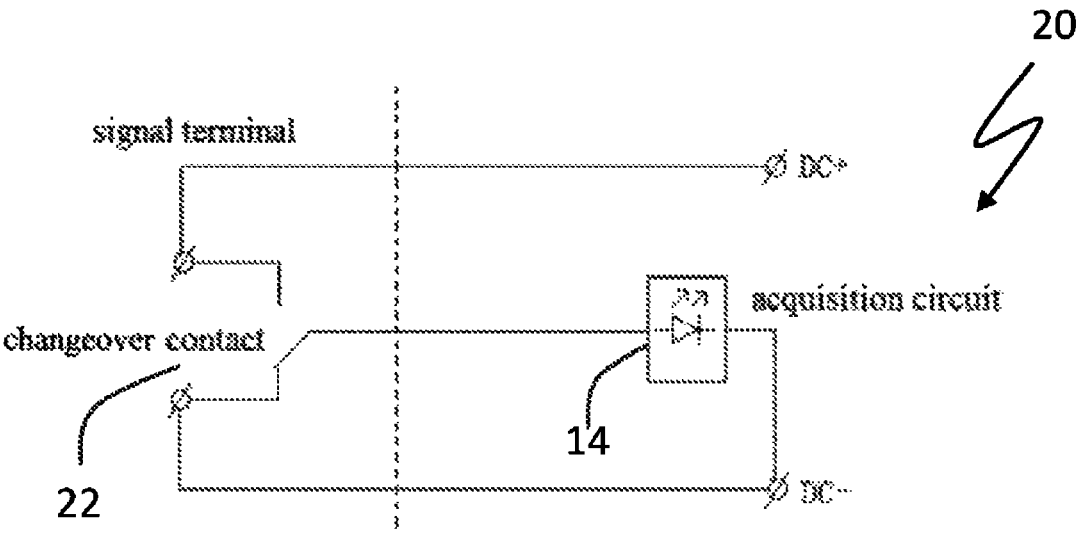
FIG. 2 schematically illustrates an anti-interference switch signal transmission circuit in accordance with an embodiment of the present invention.

FIG. 2 illustrates an anti-interference switch signal transmission circuit 20 in accordance with an embodiment of the present invention. In this circuit, the signal terminal, DC+, is connected to the normally open contact of a changeover switch 22, and DC− is connected to the normally closed contact of the changeover switch 22. The common terminal of the changeover switch 22 is connected to the switch signal acquisition circuit 14. FIG. 2 shows the switch signal acquisition circuit 14 as including an LED. A control coil (not shown) of the changeover switch 22 is serially connected into the control loop at a signal terminal (not shown). On one side of the acquisition circuit 14, a negative terminal of the circuit 14 is connected with DC− and the positive terminal thereof is linked with the common terminal of the changeover switch 22. When the control coil is not electrified, DC− is connected to the positive input terminal of the switch signal acquisition circuit 14 via the normally closed contact. Since the electric potential at both of the terminals of the switch signal acquisition circuit 14 is the same, outside interference is reduced. When the control coil is electrified (to control the action of the changeoverswitch 22), DC+ is connected to the positive input terminal of the switch signal acquisition circuit 14 via the closed normally open contact; there is a difference in electric potentials at the two terminals of the acquisition circuit 14, thus a switch signal is received.

In this invention, a DC− connection is added and replaces the normally open contact in the prior art design with a changeover switch in which the normally closed contact is connected to DC− and the normally open contact of the changeover switch is connected to DC+, and the common terminal is connected to the switch signal acquisition circuit. The advantage of this design is that it reduces unwanted interference which is incurred by level changes in other, surrounding, cables or by the external environment. When a switch signal comes in, the signal terminal changes the state of the changeover switch 22 to open the normally closed contact and close the normally open contact. Thus, a loop is formed between DC+, the closed normally open contact 22, the switch signal acquisition circuit 14, and DC−. As a result, the switch signal acquisition circuit 14 is ON and the switch signal is reflected.

The invention claimed is:

1. An anti-interference switch signal transmission circuit, comprising:

a changeover switch having a normally open contact, a normally closed contact and a common contact, wherein, in response to a received signal, the changeover switch couples the common contact to the normally open contact;

a negative terminal of a DC power supply coupled to the normally closed contact;

a positive terminal of the DC power supply coupled to the normally open contact; and a switch signal acquisition circuit having a first terminal coupled to the negative terminal and a second terminal coupled to the common contact to selectively provide positive or negative voltage to the second terminal of the switch signal acquisition circuit, wherein, when no switch signal occurs, the normally open contact is open and the normally closed contact is closed so that the first and second terminal of the switch signal acquisition circuit are negative and wherein when there is a switch signal, the normally closed contact is open and the normally open contact is closed so that the first terminal of the switch signal acquisition circuit is negative and the second terminal of the switch signal acquisition circuit is positive.

2. An anti-interference switch signal transmission circuit according to claim 1, wherein when there is no switch signal, the switch signal acquisition circuit is not affected by outside interference.

3. An anti-interference switch signal transmission circuit according to claim 1, wherein the switch signal acquisition circuit includes an LED.

* * * * *